US005461734A

United States Patent [19]

Faircloth

[11] Patent Number: 5,461,734

[45] Date of Patent: Oct. 31, 1995

[54] AUTOMATIC TOILET SEAT LOWERING

[76] Inventor: D. Michael Faircloth, P.O. Box 402412, 4580 Post Ave., Miami Beach, Fla. 33140

[21] Appl. No.: 321,725

[22] Filed: Oct. 12, 1994

[51] Int. Cl.[6] ..... A47K 13/10; A47K 13/12

[52] U.S. Cl. ..... 4/246.1; 4/246.2; 4/240; 4/241

[58] Field of Search ..... 4/236, 240, 241, 4/246.1, 246.2, 248, 234, 237

[56] References Cited

U.S. PATENT DOCUMENTS

| | | | |
|---|---|---|---|
| 900,514 | 10/1908 | Geary | 4/241 |
| 2,114,551 | 4/1938 | Winding | 4/248 |
| 2,154,240 | 4/1939 | Groeniger | 4/237 |
| 2,401,257 | 5/1946 | Levine | 4/248 |
| 3,670,441 | 6/1972 | Blount | 4/236 |
| 4,291,422 | 9/1981 | Shoemaker et al. . | |
| 4,551,866 | 11/1985 | Hibbs . | |
| 4,724,551 | 2/1988 | Gardner | 4/236 |
| 4,839,928 | 6/1989 | Probasco . | |
| 4,887,322 | 12/1989 | Lydon . | |
| 4,912,783 | 4/1990 | Shafer . | |
| 4,951,325 | 8/1990 | Tack . | |
| 4,995,120 | 2/1991 | Tager . | |
| 5,020,165 | 6/1991 | Huang | 4/241 |
| 5,058,216 | 10/1991 | Trayer et al. . | |
| 5,060,318 | 10/1991 | Jaskiewicz . | |
| 5,101,518 | 4/1992 | Phillips . | |
| 5,138,724 | 8/1992 | Chien et al. | 4/241 |
| 5,153,946 | 10/1992 | Yoke et al. . | |
| 5,193,230 | 3/1993 | Guerty . | |
| 5,222,260 | 6/1993 | Piper . | |
| 5,267,356 | 12/1993 | Gideon et al. . | |
| 5,279,000 | 1/1994 | Mercier et al. . | |
| 5,289,593 | 3/1994 | Lawrence . | |
| 5,307,524 | 5/1994 | Veal . | |
| 5,311,619 | 5/1994 | Ward . | |
| 5,327,589 | 7/1994 | Rice . | |
| 5,343,571 | 9/1994 | Guerty . | |
| 5,388,281 | 2/1995 | Wiklund et al. | 4/248 |
| 5,394,570 | 3/1995 | Tzang | 4/246.1 |

FOREIGN PATENT DOCUMENTS

| | | | |
|---|---|---|---|
| 659105 | 3/1963 | Canada | 4/236 |
| 2631053 | 11/1989 | France | 4/241 |
| 4143250 | 7/1993 | Germany | 4/237 |
| 331797 | 9/1958 | Switzerland | 4/240 |

*Primary Examiner*—Henry J. Recla
*Assistant Examiner*—Charles R. Eloshway
*Attorney, Agent, or Firm*—Fish & Richardson

[57] ABSTRACT

A toilet seat assembly for automatically closing a toilet seat includes a mount for attachment of the toilet seat to a conventional toilet bowl. The toilet seat is rotatably connected to the mount for movement between a first upright position and a lowered position. A chamber containing a movable mass is associated with the toilet seat. The mass moves in response to the force of gravity resulting in the movement of the center of gravity of the toilet seat from a first non-closing position to a second closing position causing the toilet seat to automatically close. The toilet seat assembly includes a connection of the toilet seat to the mount constructed and arranged to prevent rotation of the toilet seat about the mount to selectively maintain the toilet seat in a second upright position.

22 Claims, 2 Drawing Sheets

AUTOMATIC TOILET SEAT LOWERING

The present invention relates to automatically lowering a toilet seat.

It is an important object of this invention to provide improved methods and means for automatically lowering a toilet seat after a predetermined time has elapsed.

According to the invention, shifts in the center of gravity of a movable mass associated with a toilet seat automatically lower the toilet seat.

According to one aspect of the invention, a toilet seat assembly includes a mount for attachment of the toilet seat to a conventional toilet bowl. The toilet seat is rotatably connected to the mount for movement between a first upright position and a lowered position. A chamber containing a movable mass is associated with the toilet seat. The mass moves in response to the force of gravity resulting in the movement of the center of gravity of the toilet seat from a first non-closing position to a second closing position causing the toilet seat to automatically rotate about the mount from the first upright position to the lowered position.

According to another aspect of the invention, the chamber is located within the toilet seat. According to another aspect of the invention an underside of the toilet seat defines a track and the chamber is removably mounted to the toilet seat in the track.

According to another aspect of the invention, the toilet seat assembly includes a connection of the toilet seat to the mount constructed and arranged to prevent rotation of the toilet seat about the mount to selectively maintain the toilet seat in a second upright position. The mount includes a flexible hinge and the toilet seat includes a protrusion. The flexible hinge has arms for receiving the protrusion. The protrusion is constructed and arranged to rest against the flexible hinge when the toilet seat is in the first upright position, and to lock within the flexible hinge when the toilet seat is in the second upright position.

According to another aspect of the invention the mass is a fluid; the fluid has a selected viscosity related to the rate of movement of the fluid. According to another aspect of the invention, the mass is a solid.

According to another aspect of the invention, the toilet seat has a lower surface for engagement with the toilet bowl when the toilet seat is in the lowered position. The toilet seat has cushioning attached to the lower surface to cushion the impact of the toilet seat against the toilet bowl when the toilet seat rotates from the first upright position to the lowered position. The cushioning comprises an elastic material. The elastic material is surgical rubber tubing. The cushioning includes a firm material which carries the load of the user when the user sits on the toilet seat. The firm material is a rubber pad.

According to another aspect of the invention, the chamber is constructed and arranged such that the toilet seat, after being lifted into the first upright position, remains in the first upright position for a predetermined time while flow of the mass occurs resulting in the toilet seat lowering to the lowered position after the predetermined time. According to another aspect of the invention, the chamber has an hourglass shaped flow restriction related to the rate of movement of the movable mass.

According to another aspect of the invention, a method of using the toilet seat assembly includes applying a force to the toilet seat to lift the toilet seat, removing the applied force, and allowing the movable mass to move in response to the force of gravity such that the center of gravity of the movable mass shifts from the first non-closing position to the second closing position to automatically close the toilet seat.

According to another aspect of the invention, a method of using the toilet seat assembly includes applying a first force to the toilet seat to lift the toilet seat, and applying a second force to the toilet seat to lock the protrusion within the flexible hinge to hold the toilet seat in the second upright position.

According to another aspect of the invention, the method includes applying a third force to the toilet seat in a direction opposite the second force to release the toilet seat from the second upright position.

Numerous other features, objects and advantages of the invention will become apparent from the following detailed description when read in connection with the accompanying drawings in which.

Figure 2:
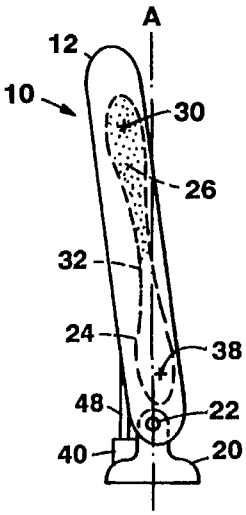
FIG. 2 is a diagrammatic representation of the automatic toilet seat lowering assembly with the toilet seat in a first upright position.
Figure 2A:
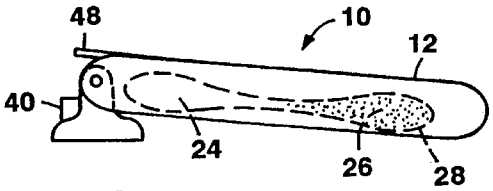
Figure 3A:
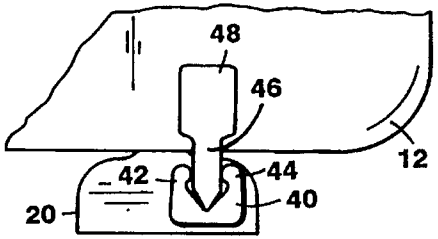
Figure 3B:
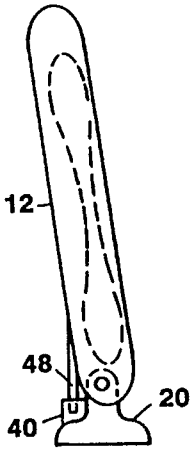
Figure 3:
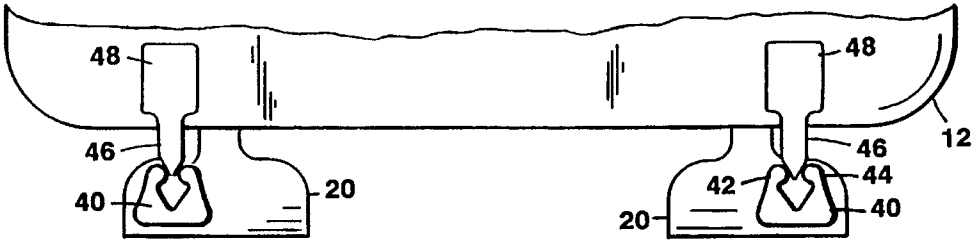
Figure 4:
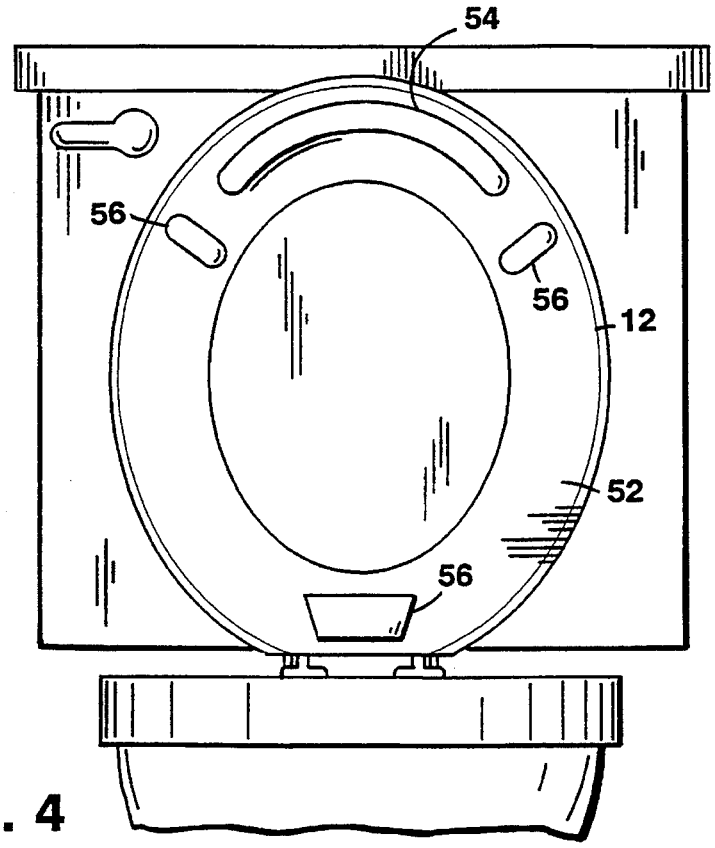

FIG. 2*a* is a diagrammatic representation of the automatic toilet seat lowering assembly with the toilet seat in a lowered position;

FIG. 3 is a partial rear view of the toilet seat locking mechanism of the invention with the toilet seat in the first upright position;

FIG. 3*a* is a rear view of one of the toilet seat locking mechanisms of the invention positioned with the toilet seat in a second upright locked position;

FIG. 3*b* is a side view of the toilet seat of FIG. 3*a* with the toilet seat in the second upright locked position;

FIG. 4 shows cushioning located on the underside of the toilet seat; and

Figure 5:
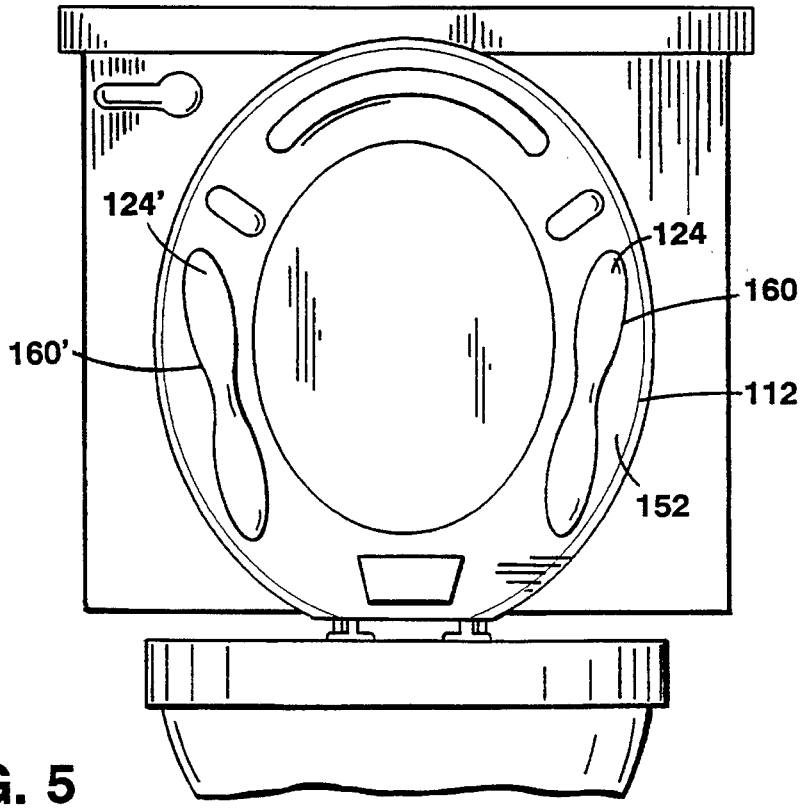

FIG. 5 shows an alternative embodiment of the automatic toilet seat lowering assembly.

Figure 1:
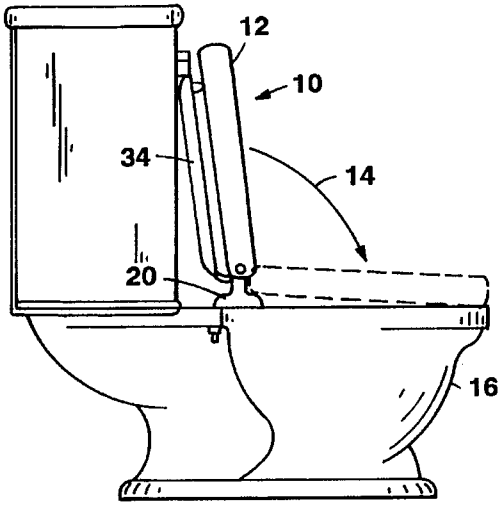
FIG. 1 is a side view of a conventional toilet bowl employing the automatic toilet seat lowering assembly of the invention.

With reference now to the drawings and more particularly FIG. 1 thereof, there is shown a toilet seat assembly 10 for automatically lowering a toilet seat 12.

Referring also to FIGS. 2 and 2*a*, a seat mount 20 is provided for attachment of toilet seat assembly 10 to a conventional toilet bowl 16. Seat 12 is rotatably connected to seat mount 20 at a point of rotation 22 for movement of toilet seat 12 along arrow 14.

Toilet seat 12 defines at least one chamber 24 containing a movable mass 26, e.g., liquid, fine sand, or metal balls, which moves in response to the force of gravity. A flow restriction 32 in chamber 24 limits the rate of flow of mass 26.

Referring particularly to FIG. 2*a*, when toilet seat 12 is closed, mass 26 tends to collect toward chamber end 28. When the toilet seat is raised to a first upright position (FIG. 2), the center of gravity of mass 26 is initially in a non-closing position 30 (shown to the left of a vertical axis A through the point of rotation 22). Mass 26 then flows downward due to the force of gravity and the center of gravity of mass 26 shifts to a closing position 38 (shown to the right of axis A) resulting in the automatic lowering of toilet seat 12.

The time that it takes for toilet seat 12 to begin lowering after it has been raised to an upright position is predetermined by the orientation of chamber 24, the shape of flow restriction 32 and the properties of mass 26. For example, a more horizontally orientated chamber 24, a smaller flow restriction 32, or a mass 26 of a liquid of high viscosity would tend to slow the flow of mass 26.

Referring to FIGS. 3–3*b*, two flexible hinges 40, 40' located on seat mount 20 are provided to enable the user to lock the toilet seat in place in a second upright position, e.g., for cleaning the toilet or because the seat has just been lowered and enough time has not elapsed for the mass to redistribute. To lock toilet seat 12 in the second upright position, a hinge mount 48 fixedly attached to toilet seat 12 and including protrusion 46 is received by arms 42, 44 of hinge 40. By applying a small amount of extra opening force, protrusion 46 pushes arms 42, 44 apart and locks in place between arms 42, 44 (FIG. 3*a*). Protrusion 46 is easily removed from flexible hinge 40 by applying a small amount of force in the seat closing direction. Flexible hinge 40' works in a similar manner.

Referring to FIG. 4, cushioning on the underside 52 of toilet seat 12 cushions the impact when toilet seat 12 falls and contacts toilet bowl 16. The cushioning includes a soft flexible elastic material 54, e.g., surgical rubber tubing, to initially cushion the impact of contact between seat 12 and toilet bowl 16, and a firmer, more rigid material 56, e.g., rubber or plastic pads, which carries the load while the user is sitting on toilet seat 12. Additionally, rotation point 22 can have enough friction to limit the speed of closing of toilet seat 12.

All parts may be formed from injection molded plastic. In an exemplary embodiment, toilet seat 12 is formed of a clear plastic and mass 26 includes decorative features, e.g., colored sparkles, which can be seen within chamber 24 through the clear plastic of toilet seat 12. In an additional embodiment, toilet seat 12 defines two chambers.

Referring to FIG. 5, in an alternative embodiment, chamber 124 may be removably mounted within a track 160 on the underside 152 of toilet seat 112. In one embodiment, chamber 124 is formed of a clear plastic allowing viewing of the movable mass contained therein. In an exemplary embodiment, toilet seat 112 defines a second track 160' for receiving a second chamber 124' as shown in FIG. 5.

It can be seen that the automatic toilet seat lowering assembly of the invention is applicable to lid closing as well.

Other embodiments are within the following claims.

What is claimed is:

1. A toilet seat assembly for automatically closing a toilet seat, comprising:

a mount for attachment of said toilet seat to a conventional toilet bowl, said toilet seat rotatably connected to said mount for movement between a first upright position and a lowered position, a chamber integrally associated with said toilet seat for providing said toilet seat with an adjustable center of gravity, said chamber containing a movable mass, said mass moving in response to the force of gravity acting thereon resulting in the movement of the center of gravity of said toilet seat from a first non-closing position to a second closing position causing said toilet seat to automatically rotate about said mount from said first upright position to said lowered position.

2. The toilet seat assembly of claim 1 wherein said chamber is located within said toilet seat.

3. The toilet seat assembly of claim 1 wherein an underside of said toilet seat defines a track, said chamber being removably mounted to said toilet seat in said track.

4. The toilet seat assembly of claim 1 and further comprising a connection of said toilet seat to said mount constructed and arranged to selectively prevent rotation of said toilet seat about said mount after said toilet seat has been rotated to a second upright position.

5. The toilet seat assembly of claim 4 wherein said mount further comprises a flexible hinge and said toilet seat further comprises a protrusion, said flexible hinge having arms for receiving said protrusion, said protrusion constructed and arranged to rest against said flexible hinge when said toilet seat is in said first upright position, and said protrusion constructed and arranged to lock within said flexible hinge when said toilet seat is in said second upright position.

6. A method of using the toilet seat assembly of claim 5 including the steps of:

applying a first force to said toilet seat to lift said toilet seat, and applying a second force to said toilet seat to lock said protrusion within said flexible hinge to hold said toilet seat in said second upright position.

7. The method of claim 6 including the step of:

applying a third force to said toilet seat in a direction opposite said second force to release said toilet seat from said second upright position.

8. The toilet seat assembly of claim 1 wherein said mass is a fluid.

9. The toilet seat assembly of claim 8 wherein said fluid has a selected viscosity which at least in part determines a rate at which said fluid moves.

10. The toilet seat assembly of claim 1 wherein said mass is a solid.

11. The toilet seat assembly of claim 1 wherein said toilet seat has a lower surface for engagement with said toilet bowl when said toilet seat is in the lowered position, said toilet seat further comprising cushioning attached to said lower surface to cushion the impact of said toilet seat against said toilet bowl when said toilet seat rotates from said first upright position to said lowered position.

12. The toilet seat assembly of claim 11 wherein said cushioning comprises an elastic material.

13. The toilet seat assembly of claim 12 wherein said elastic material is surgical rubber tubing.

14. The toilet seat assembly of claim 12 wherein said cushioning further comprises a firm material which transfers the weight of the user from said toilet seat to said toilet bowl when the user sits on said toilet seat.

15. The toilet seat assembly of claim 14 wherein said firm material is a rubber pad.

16. The toilet seat assembly of claim 1 wherein said chamber is constructed and arranged such that said toilet seat, after being lifted into said first upright position, remains in said first upright position for a predetermined time while flow of said mass occurs resulting in said toilet seat lowering to said lowered position after said predetermined time.

17. The toilet seat assembly of claim 1 wherein said chamber has an hourglass shaped flow restriction which at least in part determines a rate at which said mass moves.

18. A method of using the toilet seat assembly of claim 1 including the steps of:

applying a force to said toilet seat to lift said toilet seat, removing said applied force, and allowing said movable mass to move in response to the force of gravity acting thereon such that the center of gravity of said toilet seat moves from said first non-closing position to said second closing position to automatically close said toilet seat.

19. A toilet seat assembly for automatically closing a toilet seat, comprising:

a mount for attachment of said toilet seat to a conventional toilet bowl, said toilet seat rotatably connected to said mount for movement between a first upright position and a lowered position, a chamber located within said toilet seat for providing said toilet seat with an adjustable center of gravity, said chamber containing a movable mass, said mass moving in response to the force of gravity acting thereon resulting in the movement of the center of gravity of said toilet seat from a first non-closing position to a second closing position causing said toilet seat to automatically rotate about said mount from said first upright position to said lowered position.

20. A toilet seat assembly for automatically closing a toilet seat, comprising:

a mount for attachment of said toilet seat to a conventional toilet bowl, said toilet seat rotatably connected to said mount for movement between a first upright position and a lowered position, a connection of said toilet seat to said mount constructed and arranged to selectively prevent rotation of said toilet seat about said mount after said toilet seat has been rotated to a second upright position, wherein said mount further comprises a flexible hinge and said toilet seat further comprises a protrusion, said flexible hinge having arms for receiving said protrusion, said protrusion constructed and arranged to rest against said flexible hinge when said toilet seat is in said first upright position, and said protrusion constructed and arranged to lock within said flexible hinge when said toilet seat is in said second upright position, a chamber associated with said toilet seat for providing said toilet seat with an adjustable center of gravity, said chamber containing a movable mass, said mass moving in response to the force of gravity acting thereon resulting in the movement of the center of gravity of said toilet seat from a first non-closing position to a second closing position causing said toilet seat to automatically rotate about said mount from said first upright position to said lowered position.

21. A method of using the toilet seat assembly of claim 20 including the steps of:

applying a first force to said toilet seat to lift said toilet seat, and applying a second force to said toilet seat to lock said protrusion within said flexible hinge to hold said toilet seat in said second upright position.

22. The method of claim 21 including the step of:

applying a third force to said toilet seat in a direction opposite said second force to release said toilet seat from said second upright position.

* * * * *